US008118161B2

(12) United States Patent
Guerrera et al.

(10) Patent No.: US 8,118,161 B2
(45) Date of Patent: Feb. 21, 2012

(54) PRESSURIZED CIGARETTE PACKAGES AND METHODS

(75) Inventors: Stephen K. Guerrera, Holliston, MA (US); Edward Joseph Goldman, Foxborough, MA (US); David J. Smith, Needham, MA (US); Malcolm E. Taylor, Warner, NH (US); Robert Francis Kovar, Wrentham, MA (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 301 days.

(21) Appl. No.: 12/544,720

(22) Filed: Aug. 20, 2009

(65) Prior Publication Data

US 2011/0042249 A1 Feb. 24, 2011

(51) Int. Cl.
*B65D 81/26* (2006.01)

(52) U.S. Cl. ..... 206/274; 229/87.05; 383/204

(58) Field of Classification Search ..... 229/87.13, 229/87.03, 87.05; 383/204; 206/274
See application file for complete search history.

(56) References Cited

U.S. PATENT DOCUMENTS

| | | | | |
|---|---|---|---|---|
| 1,886,115 | A | | 11/1932 | Müller |
| 3,695,422 | A | | 10/1972 | Tripodi |
| 3,874,581 | A | | 4/1975 | Fox et al. |
| 3,944,066 | A | | 3/1976 | Niepmann |
| 3,948,389 | A | | 4/1976 | Molins et al. |
| 3,967,730 | A | | 7/1976 | Driscoll et al. |
| 4,375,260 | A | | 3/1983 | Focke et al. |
| 4,717,017 | A | | 1/1988 | Sprinkel, Jr. et al. |
| 4,807,745 | A | * | 2/1989 | Langley et al. ..... 206/245 |
| 4,836,378 | A | | 6/1989 | Lephardt |
| 4,852,734 | A | | 8/1989 | Allen et al. |
| 4,911,302 | A | | 3/1990 | Butler |
| 5,139,140 | A | | 8/1992 | Burrows et al. |
| 5,192,262 | A | | 3/1993 | Amendola et al. |
| 5,248,031 | A | | 9/1993 | Burrows et al. |
| 5,333,729 | A | | 8/1994 | Wolfe |
| 5,542,529 | A | | 8/1996 | Hein, III et al. |
| 5,595,803 | A | | 1/1997 | May et al. |
| 5,682,986 | A | | 11/1997 | Cobler |
| 5,729,957 | A | | 3/1998 | Spada |
| 5,897,052 | A | * | 4/1999 | Tanaka et al. ..... 229/205 |
| 5,938,018 | A | | 8/1999 | Keaveney et al. |

(Continued)

FOREIGN PATENT DOCUMENTS

EP 392737 B1 10/1993

(Continued)

OTHER PUBLICATIONS

Petrie, Edward M., "Heat-Seal Adhesive Coatings," SpecialChem, May 21, 2007, www.specialchem4adhesives.com/resources/print.aspx?id=1827, 7 pages.

(Continued)

*Primary Examiner* — J. Gregory Pickett
*Assistant Examiner* — Raven Collins
(74) *Attorney, Agent, or Firm* — Brinks Hofer Gilson & Lione

(57) ABSTRACT

A cigarette or other tobacco product package may be constructed with a sealed outer overwrap. The overwrap may be multi-layered and configured to contain an internal pressure higher than an ambient external air pressure. The multilayer overwrap may be assembled to a cigarette or other tobacco product pack in two or more layers adhered together during assembly.

14 Claims, 8 Drawing Sheets

U.S. PATENT DOCUMENTS

| | | | | |
|---|---|---|---|---|
| 6,085,904 | A * | 7/2000 | Perdue, Jr. | 206/484 |
| 6,164,287 | A | 12/2000 | White | |
| 6,256,905 | B1 | 7/2001 | White | |
| 6,363,691 | B1 | 4/2002 | Flaherty | |
| 6,694,708 | B2 | 2/2004 | Brizzi et al. | |
| 6,874,623 | B2 | 4/2005 | Bray | |
| 7,118,792 | B2 | 10/2006 | Hewitt et al. | |
| 2008/0029117 | A1 | 2/2008 | Mua et al. | |
| 2008/0173317 | A1 | 7/2008 | Robinson et al. | |
| 2008/0230410 | A1 | 9/2008 | Jones et al. | |
| 2009/0255835 | A1 | 10/2009 | Pipes et al. | |

FOREIGN PATENT DOCUMENTS

| | | | |
|---|---|---|---|
| EP | 0 960 831 | A1 | 1/1999 |
| EP | 1 637 469 | A1 | 3/2006 |
| WO | WO 96/14763 | A1 | 5/1996 |
| WO | WO 01/83326 | A1 | 11/2001 |
| WO | WO 2006/032661 | A1 | 3/2006 |
| WO | WO 2006/082571 | A1 | 8/2006 |
| WO | WO 2009/083344 | A2 | 9/2009 |

OTHER PUBLICATIONS

Petrie, Edward M., "Adhesives Help Provide Barriers to Improve the Shelf-Life of Packaged Food and Pharmaceuticals," SpecialChem, Apr. 22, 2009, www.specialchem4adhesives.com/resources/print.aspx?id=2734, 5 pages.

Unknown author, "Nitrogen Gas Packing Functions Document: Packing Functions and Relevant Test of Nitrogen Gas," Labthink, 3 pages.

PCT Notification of Transmittal of the International Search Report and the Written Opinion of the International Searching Authority, or the Declaration for International Application No. PCT/US2010/044980, date of mailing Oct. 4, 2010, 14 pages.

* cited by examiner

PRESSURIZED CIGARETTE PACKAGES AND METHODS

TECHNICAL FIELD

The present invention relates generally to tobacco products, such as smoking articles and in particular to packages for containing tobacco products such as cigarettes.

BACKGROUND

Popular smoking articles such as cigarettes have a substantially cylindrical rod shaped structure and include a charge of smokable material such as shredded tobacco (e.g., cut filler) surrounded by a paper wrapper thereby forming a so-called "tobacco rod." It has become desirable to manufacture cigarettes having cylindrical filter elements aligned in an end-to-end relationship with the tobacco rod. Typically, filter elements are manufactured from fibrous materials such as cellulose acetate and plug wrap, and are attached to the tobacco rod using a circumscribing tipping material. Such cigarettes having filter elements are referred to as "filter cigarettes."

Filter cigarettes conventionally have been sold in packages, each package normally containing twenty (20) cigarettes. Typical cigarette packages have a generally rectangular parallelepiped form. One type of popular cigarette package employs a container having the form of a so-called "hard pack," "crush proof box" or "hinged lid package." See, for example, U.S. Pat. No. 3,874,581 to Fox et al.; U.S. Pat. No. 3,944,066 to Niepmann; and, U.S. Pat. No. 4,852,734 to Allen et al.; as well as European Pat. 0392737 to Moeller, and U.S. Pub. Pat. App. No. 2008/0230410 to Jones et al., each of which is incorporated herein by reference. Another type of popular cigarette package employs a container having the form of the so-called "soft pack." See, for example, U.S. Pat. No. 3,695,422 to Tripodi; U.S. Pat. No. 4,717,017 to Sprinkel, Jr., et al.; and, U.S. Pat. No. 5,333,729 to Wolfe; each of which is incorporated herein by reference. Both types of cigarette packages are normally packed in cartons also of generally rectangular parallelepiped form, typically ten (10) packages to a carton.

These conventional cigarette packages are generally configured to maintain the freshness and moisture content of the cigarettes and to protect the cigarettes from adverse environmental conditions that could degrade their freshness and quality. Such conventional cigarette packages typically comprise three separate wrappings: (1) an inner foil liner comprising a metal foil laminated to a paper substrate or a metallized paper which is wrapped about the cigarettes and folded, but not sealed, at the ends of the cigarettes; (2) a "soft" or "hard" paper or paperboard package which is usually imprinted with brand specific information; and (3) an exterior clear overwrap of a heat sealable polymeric film polymeric film which is heat sealed.

A strip of polymeric material known as a "tear tape" is provided for easy opening of the polymeric overwrap films. Exemplary tear tapes are disclosed in U.S. Pat. No. 4,717,017 to Sprinkel, Jr. et al.; U.S. Pat. No. 4,836,378 to Lephardt; U.S. Pat. No. 5,192,262 to Amendola et al.; U.S. Pat. No. 5,595,803 to May et al.; U.S. Pat. No. 6,363,691 to Flaherty; and U.S. Pat. No. 7,118,792 to Hewitt et al., each of which is incorporated herein by reference. The tear tape typically is positioned adjacent and parallel to the top edge of the package. One end of the tear tape normally projects slightly from the package as a tab. To open the package, the tab is pulled by the smoker to open the polymeric overwrap. In particular, the projecting tab of the tear tape is pulled to slit the polymeric overwrap along both edges of the tear tape and the polymeric overwrap covering the top of the container is removed. The top of the package is then opened, i.e., the foil inner liner is torn open in the case of the soft pack or the hinged lid of the hard pack is pivoted open and a portion of the foil inner liner is removed to expose the ends of the cigarettes contained therein. The smoker then grasps the end, usually the filter end, of a cigarette with his/her fingers to remove it from the package.

Typically, the polymeric overwrap material comprises an oriented polypropylene which may be (a) a heat seal modified oriented polypropylene, (b) an acrylic heat seal coated polypropylene, or (c) a coextruded ABA type oriented polypropylene film wherein the A layers are fusion heat sealable polypropylene/polyethylene copolymer and the B layer is an oriented homopolymer of polypropylene. The composition of the heat seal layers is selected to optimize the heat sealing characteristics of the overwrap, i.e., the lowest practicable heat seal temperature and the shortest practicable dwell time. At the same time, however, the heat seal layer of the overwrap normally provides the necessary slip or antistick characteristics so that overwrapped cigarette packages readily slip or slide relative to one another during the manufacturing process and during dispensing of the cigarette packages, for example, for a cigarette vending machine. Accordingly, selection of the heat seal layer composition is essentially a trade off between optimum heat seal characteristics and optimum slip characteristics.

Under normal storage conditions and normal shelf life, the conventional cigarette package described above is capable of maintaining the freshness and moisture content of the cigarettes at an acceptable level for a limited period of time. However, if the cigarette packages are exposed to a longer than normal shelf life, or if the cigarette packages are stored in unusually hot and/or dry atmospheric conditions, the conventional package does not adequately preserve the freshness and moisture content of the cigarettes. In particular, the foil inner liner of the conventional cigarette package has a primarily decorative purpose inasmuch as the paper-backed foil liner is only overlapped at its longitudinal seam and folded over on the top and bottom of the package without sealing. Thus, the foil inner liner provides little or no barrier to the passage of oxygen and moisture between the cigarettes in the pack and the surrounding atmosphere. While the barrier effectiveness of the conventional heat sealed polypropylene overwrap is significantly greater than the conventional foil inner liner, the conventional overwrap does permit loss of moisture and flavor over a period of weeks so that the consumer can ascertain a change in the freshness of the product. If an extended shelf life or storage under adverse temperature and humidity conditions is encountered, there can result a staleness of the tobacco, a moisture loss, and a loss of tobacco flavor or aroma, including a loss of flavor additives, such as menthol.

Various packaging overwraps and inner liners have been proposed for improving the barrier properties of cigarette packages. For example, U.S. Pat. No. 3,948,389 to Molins et al. discloses an air impervious inner liner for a cigarette package wherein an air impervious tube is sealed flat with the resulting margin and triangulated ends being folded against the packet. Because of the resulting unusual end flap structure, the packages cannot be sealed by current cigarette package manufacturing equipment. U.S. Pat. No. 4,375,260 to Focke et al. discloses a laminated foil inner liner which, as in the case of the aforementioned Molins et al. patent, has an unusual end flap structure and cannot therefore be made by conventional cigarette packaging equipment. In addition, the Focke et al. inner liner has an easy opening preperforated feature which can result in severing of the impervious foil layer thereby reducing the barrier properties of the inner liner. U.S. Pat. No. 4,807,745 to Langley et al. discloses a barrier heat sealed package for cigarettes. The package material comprises a relatively thick laminate made of a foil layer to which two layers of biaxially oriented polypropylene homopolymer are adhesively bonded on opposite sides and exterior and interior surface layers of a heat sealable thermoplastic polymer are applied. This laminate is disclosed as being useful as an overwrap for a soft or hard pack or as a sealed inner liner for a soft or hard pack. Other overwrap materials known in the art include those with tamper-evident properties (e.g., U.S. Pat. No. 4,911,302 to Butler), aroma-releasing properties (U.S. Pat. No. 5,938,018 to Keaveney et al.)

It would be desirable to provide a heat sealable high barrier cigarette package overwrap or a cigarette carton overwrap of a gauge equal to or less than that of the conventional polypropylene overwrap for packages and export cartons. Such as overwrap desirably would preserve the freshness and moisture content of the cigarettes contained in the package or carton, thus, minimizing changes which might be detected by the consumer after passage of the normal period of time between cigarette manufacture and consumption. In addition, such as overwrap could increase the normal shelf life of the cigarettes or maintain a shelf life equal to or greater than normal shelf life under the most adverse storage conditions. Advantageously, such a cigarette package or carton would also be compatible with existing cigarette manufacturing and packaging equipment to the extent that major modifications of that equipment are not required to maintain production rates at least equal to present rates of cigarette package and carton production. In addition, it would be desirable to provide a high barrier cigarette package that has an external appearance at least comparable to conventional cigarette packages and also that may be opened in the same way as a conventional cigarette package. It would also be desirable to provide a high barrier cigarette package that has slip characteristics equivalent to or better than conventional cigarette packages.

These packages may include a laminate packaging component for barrier-sealed cigarettes including a foil layer, such as is described in U.S. Pat. No. 4,807,745 to Langley, and/or an outer film wrap of a type described by in U.S. Pat. No. 5,542,529 to Hein, each of which is incorporated herein by reference. Various modifications have been proposed to different cigarette package designs to enhance consumer acceptance and appreciation of the look and feel of a package. For example, it has been disclosed to round off the portions of a hard pack leading to the corners of the package to yield a "pillow-type" cigarette package, such has been disclosed in U.S. Pat. No. 6,694,708 to Brizzi et al. which is incorporated herein by reference. Alternatively, it has been disclosed to provide multiple methods of accessing the cigarettes. For example, U.S. Pat. No. 5,682,986 to Cobler, U.S. Pat. No. 5,139,140 to Burrows et al., and U.S. Pat. No. 5,248,031 to Burrows et al., each of which is incorporated herein by reference, disclose a removable portion of the lid of a hard-pack thereby providing for soft-pack style accessibility in addition to the hard-pack flip-top.

Modified atmosphere packaging has been introduced for a number of different products, including food products (see., e.g., U.S. Pat. No. 6,256,905 to White) and smokeless tobacco products (see, e.g., U.S. Pub. Pat. Apps. 2008/0029117 to Mua, et al. and 2008/0173317 to Robinson, et al., each of which is incorporated herein by reference). Single-pack, small-batch pack, and multipack cigarette containers with a modified internal atmosphere have been attempted, but each such package includes structural limitations that generally have prevented maintaining the appearance of a standard cigarette package with which most consumers are most familiar. See, for example, U.S. Pat. No. 5,729,957 to Spada and PCT App. Pub. Nos. 96/14763 to Brown et al.; WO01/83326 to Šrámek et al.; and WO06/32661 to Weiss et al., which show modified atmosphere containers having a non-traditional cigarette pack shape. Other examples of non-conventional packaging shapes for smoking articles include U.S. Pat. No. 1,886,115 to Müller; U.S. Pat. No. 3,967,730 to Driscoll.

It is desirable to develop more attractive packaging for cigarettes, providing both visual and tactile attractiveness for consumers. In addition, it is desirable to provide packaging that communicates product quality and freshness.

SUMMARY

Cigarette packages as claimed herein may include a fluid-tight seal allowing an interior package compartment containing cigarettes to contain a pressurized fluid such as a gas at a higher pressure level than ambient atmospheric pressure outside of the package. The pressurized fluid may be an inert gas that was introduced into the package in the form of a liquid or a solid and allowed to evaporate or sublimate into gaseous form, thereby effecting a pressure increase in the inner space of the package.

BRIEF DESCRIPTION OF THE DRAWINGS

The invention may be more fully understood by reading the following description in conjunction with the drawings.

DETAILED DESCRIPTION

Figure 1A:
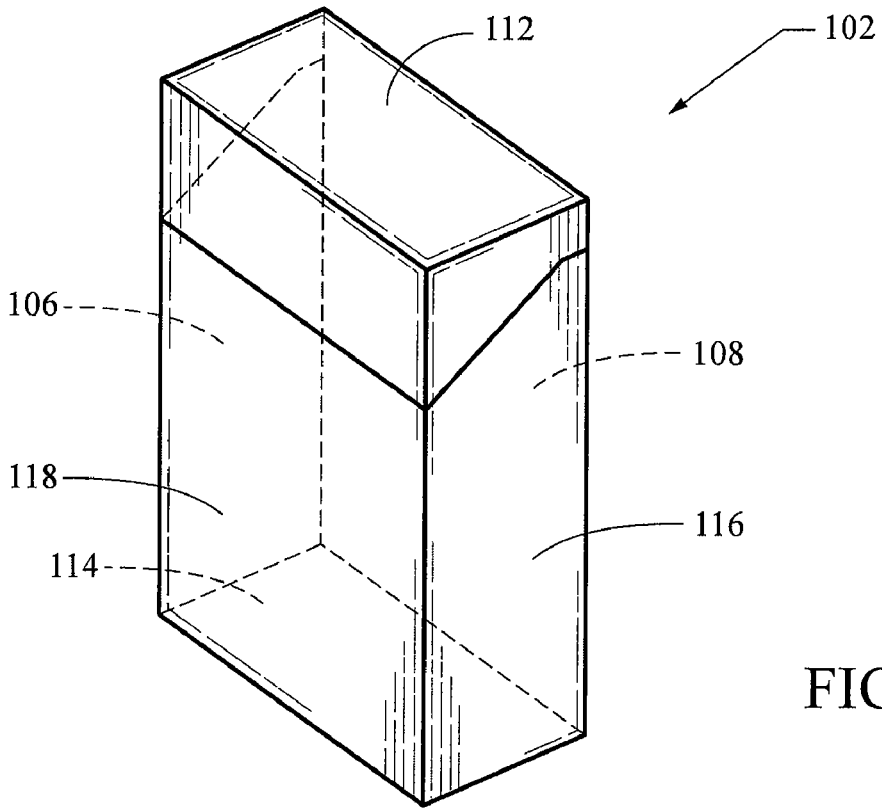
FIGS. 1A-1D show steps of assembling a pressurized cigarette package.

For the sake of simplicity, the same reference number generally is used for any common part shown in any of the various figures throughout this Detailed Description. One embodiment of a pressurized cigarette package 100 is described here with reference to FIGS. 1A-1D, which illustrate steps of assembling the package 100. First, as shown in FIG. 1A, an inner cigarette pack portion 102 is provided. The pack 102 is illustrated as a standard cuboid parallelepiped-shaped box, and may be configured as a hard-pack or a soft pack, assembled in a manner typically used for known cigarette packs. In other embodiments, the geometry of the pack 102 may be cylindrical or another three-dimensional geometry without departing from the scope of the present disclosure and claimed invention. The pack 102 includes a front face 106, a rear face 108, top and bottom faces, 112, 114 (respectively), and first and second side faces 116, 118.

Figure 1B:
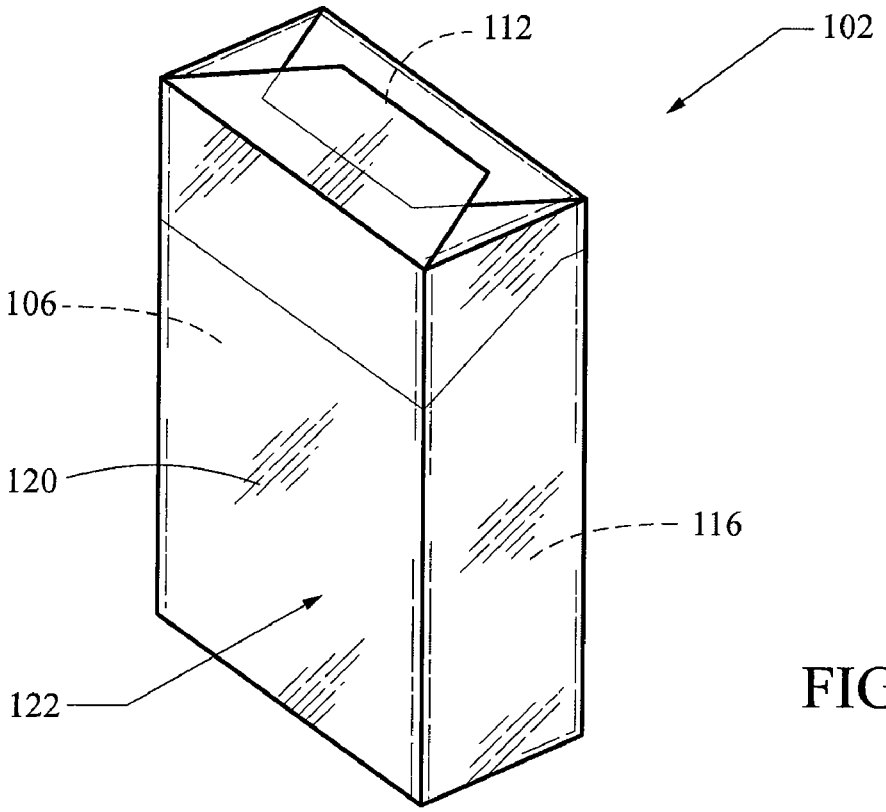
Figure 1C:
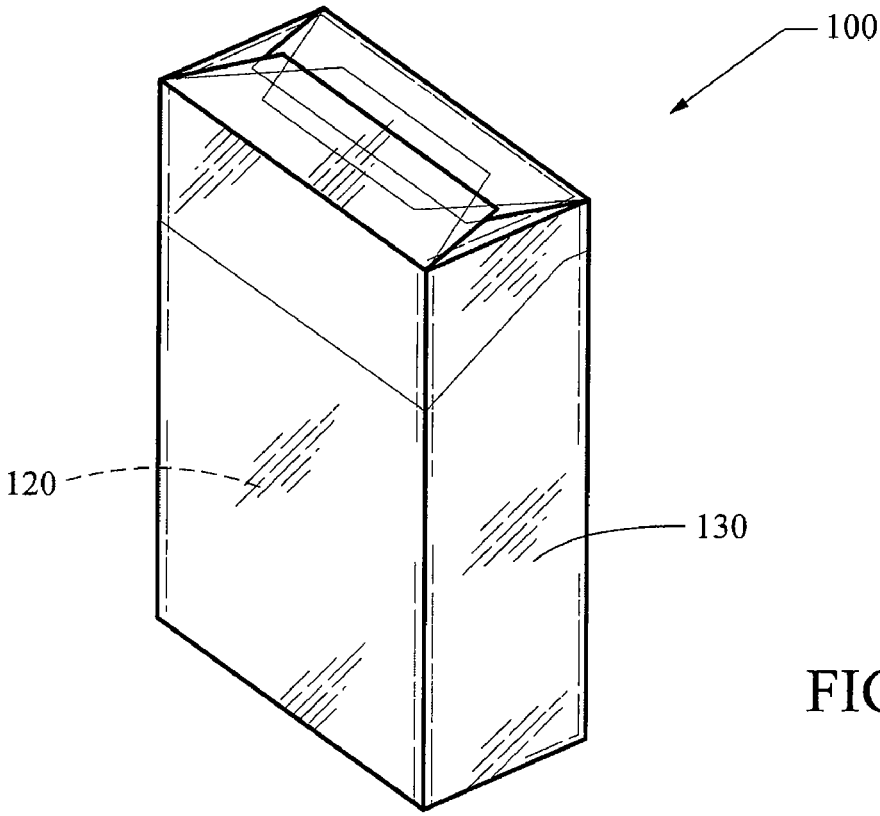

Next, as shown in FIG. 1B, a first film overwrap 120 is applied in a manner like that used for known film overwraps as described above. Then, as shown in FIG. 1C, a second film overwrap 130 is applied over the first film overwrap, again in a manner like that used for known film overwraps as described above. For example, the overwraps are wrapped around the front, rear, and side faces (106, 108, 116, 118), then the ends are folded to close over the top and bottom faces (112, 114) in the manner traditionally used for polypropylene and/or cellophane-type overwraps.

An external surface 122 of the first film overwrap 120 may include an adhesive material 124. The adhesive material may be in a pattern such as, for example, only along selected corner/edge surfaces that run along the juncture of faces of the pack 102. Alternatively, or in addition, the adhesive material 124 may be made of a material and or applied in a pattern configured not to be visually distinguishable from indicia (printing, images, etc.) on the pack 102, and/or not to be substantially visible to an observer looking at an assembled package 100. Alternatively, or in addition, the adhesive material 124 may be made of a material and or applied in a pattern configured to form visually distinguishable indicia (printing, images, etc.) on the pack 102, either alone or in combination with the second overwrap 130.

Figure 1D:
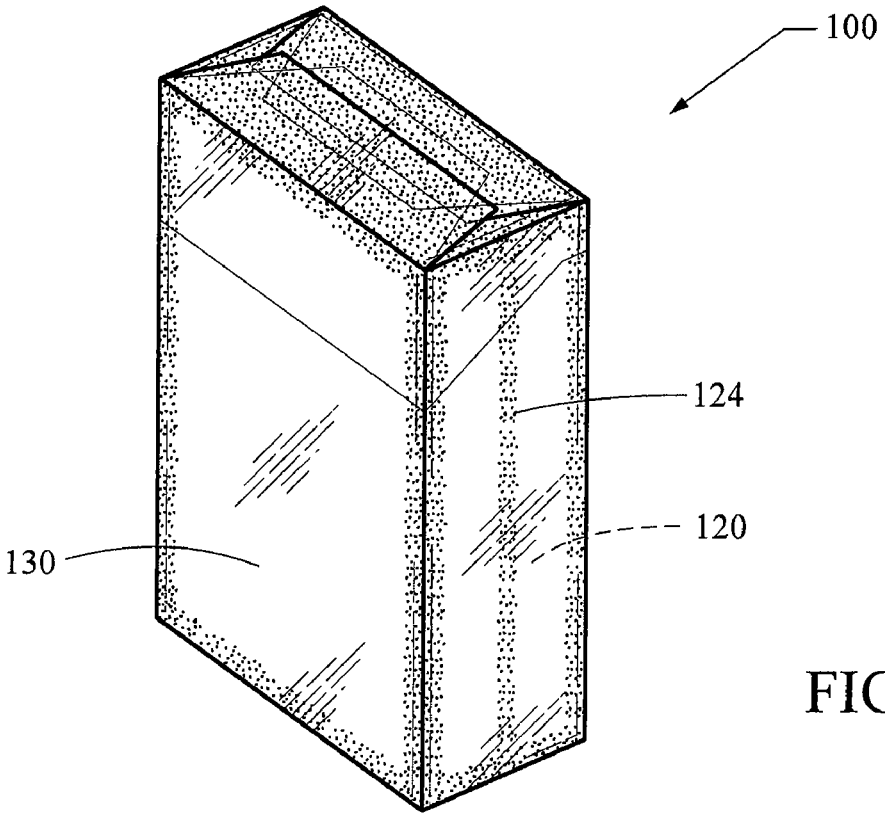

In other embodiments, the adhesive material may alternatively, or additionally, be applied to or constructed as present upon an inward-facing surface of the second film overwrap 130, and otherwise configured as described above. The adhesive pattern between the overwraps 120, 130 preferably is sufficiently wide everywhere it is applied to minimize the likelihood of gases passing thereacross. The inner and outer overwraps together form an outer wrapper for the package 100 that is configured as a substantially airtight barrier. The adhesive may cover substantially the entire outer surface of the first overwrap 120 and/or the second overwrap 130. One potential pattern of adhesive 124 is shown in FIG. 1D as a darkly-patterned set of stippled regions, but it should be appreciated that a finished package may look substantially like FIG. 1C or the like, where the adhesive substantially is not visible.

The adhesive material 124 preferably is configured to provide a substantially fluid-tight seal around the entirety of the pack 102, forming a sealed package 100. This may be accomplished, for example, by providing a heat-seal adhesive applied to encompass at least all seam surfaces where each of the overwraps 120, 130 contacts itself. In such an embodiment, heat may be applied to activate the adhesive and provide a seal that preferably is substantially fluid-tight and configured to maintain a pressure within the package 100 contained by overwraps 120, 130 that is greater than an ambient air pressure outside the package. The fluid-tight seal may include a substantially complete gas-tight seal between the overwraps 120, 130, and/or the seal may provide a very-low surface area, tortuous path for passage of a gas between the inside and outside of the sealed package 100.

Adhesive material may include, for example heat-sealing adhesives, pressure-sensitive adhesives, and tacky adhesives. Examples of low-melting polymers that may be used as a sealing/adhesive layer include polypropylene, ethylvinylacetate (EVA), ethylbutylacrylate (EBA) and other acrylic copolymers, ethylenevinylacetate maleic anhydride terpolymers, anhydride grafted polyolefins, ethyleneacrylicester maleic anhydride or glycidyl methacrylate terpolymers, and/or ionomers. Specific examples of lower temperature heat-sealing polymers include HEVA, ethylene acrylic acid (EAA), LEVA, LLDPE, and LDPE. The adhesives may be water-based and/or able to be applied in aqueous form (e.g., EVA, EAA, ethylene methacrylate (EMA), ethylene methyl methacrylate (EMMA), polyvinyl alcohol (PVA), ionomer, acrylic, polyvinylidene chloride (PVdC)), and some also—or alternatively—may be applied in a solvent-based form (e.g., EVA, ethylene methacrylate (EMA), ethylene methyl methacrylate (EMMA), polyvinyl alcohol (PVA), ionomer, acrylic, vinyl, polyester, polypropylene, polyamide). They may be provided in solution, emulsion, or other applicable forms. Adhesives used may include ultraviolet-curable adhesives, reactive hot melt adhesives (that are applied like a conventional hot melt, but then cross-linked (e.g., moisture-curable polyurethane, silicone), and or other materials known for use as sealants and adhesives. For heat-activated adhesives, lower activation temperatures are preferred, providing for reduced likelihood of thermal degradation to other package components or contents, and increasing the speed of a manufacturing process. Various of these adhesives may be used in combination with each other (e.g., in the same and/or in different surface zones of a package).

Adhesive material may also include those used in other packages such as, for example, in pending U.S. application Ser. No. 12/101,529 to Pipes et al.; U.S. Pat. No. 4,807,745 to Langley; and U.S. Pat. No. 5,542,529 to Hein, each of which is incorporated herein by reference. In one example, a transparent hot-melt adhesive may be used to affix selected surfaces of the overwraps 120, 130. The hot-melt adhesive may be a pressure sensitive hot-melt adhesive, which preferably will be non-solvent based and include 100 percent solids. Such a hot-melt adhesive material most preferably conforms to food grade regulations in compliance with 21 C.F.R. §175.105. In one embodiment, the hot-melt adhesive may contain Styrene-Butadiene-Styrene (SBS) polymer with plasticizers, tackifiers, waxes, and/or stabilizers. However, those skilled in the art will understand that other polymer materials may be used. In another embodiment, the hot-melt adhesive may include a pressure sensitive, quick setting adhesive such as Primamelt® 37-613 from Henkel Adhesives of Elgin, Ill., or Uni-Flex® 70-007A from National Starch and Chemical Company of Bridgewater, N.J. However, other adhesive materials may be used as is apparent to those skilled in the art. Preferably, a transparent, quick setting adhesive that is compatible with the overwrap material is used, although non-transparent adhesives may be used in a preferred manner if at least the outer overwrap is metalized or otherwise substantially opaque, or no more than minimally transparent.

One or both overwrap films may include one or more of nitrile copolymer or polypropylene films, that may be metalized or laminated, thin solid aluminum. One or both overwraps may include alumina (Al2O3)-coated polyethylene terephthalate (PET) film, transparent alumina-coated PET film, silicon oxide-coated PET film, and/or EVOH-coated film. Other films characterized as "cellophane-type films" conventionally have been employed for wrapping packaged cigarettes. Overwrap materials may be used such as the types set forth in U.S. Pat. No. 4,807,745 to Langley et al.; U.S. Pat. No. 5,139,140 to Burrows et al.; U.S. Pat. No. 5,542,529 to Hein, III et al.; and U.S. Pat. No. 6,874,623 to Bray, each of which is incorporated herein by reference, but each would preferably be modified to include a double-layered overwrap in the novel manner disclosed herein. Other embodiments may be practiced within the scope of the present disclosure including an embodiment with a multi-layer overwrap having more than two layers.

Figure 3A:
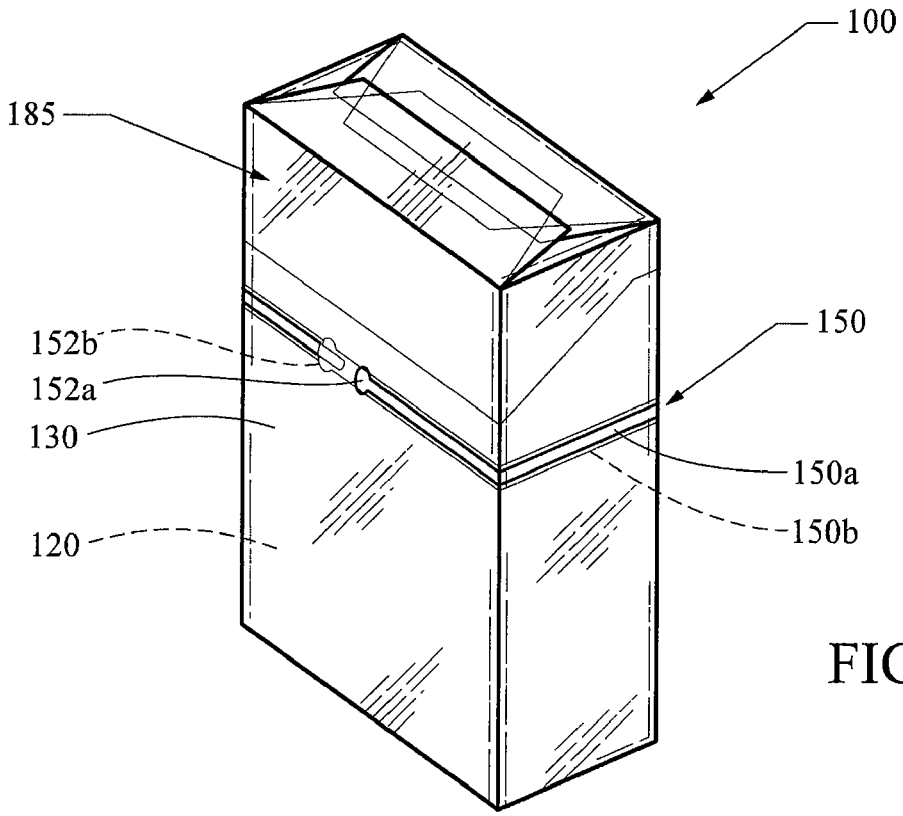
FIGS. 3A-3D show a pressurized cigarette package with tear-tape and a method for opening same.

As referenced in FIG. 3A a substantially transparent coating 185 may be applied over the overwrap to enhance and/or preserve its airtight seal. Coatings that may provide desirable sealing qualities without adversely affecting the appearance and/or tactile feel of the package 100 include parylene, which can be applied through chemical vapor deposition, through a number of processes known in the coatings art, Other potential coatings include aqueous and/or polymer suspensions, which may be applied by dipping or spraying (such as, for example, InMat Air D-Fense 2000™, InMat Nanolok PT™ coating, InMat Nanolok HSC™ coating, or CCC Enviroclear™ Barrier Coating). Such coatings may include nanodispersed silicate platelets in butyl rubber latex or a polymer (e.g., polyester) matrix. Or, they may be applied as quick-drying aqueous suspensions of polymer film(s) such as, for example, carboxymethyl cellulose, PVOH, Saran PVDC, or other similar films.

Figure 2:
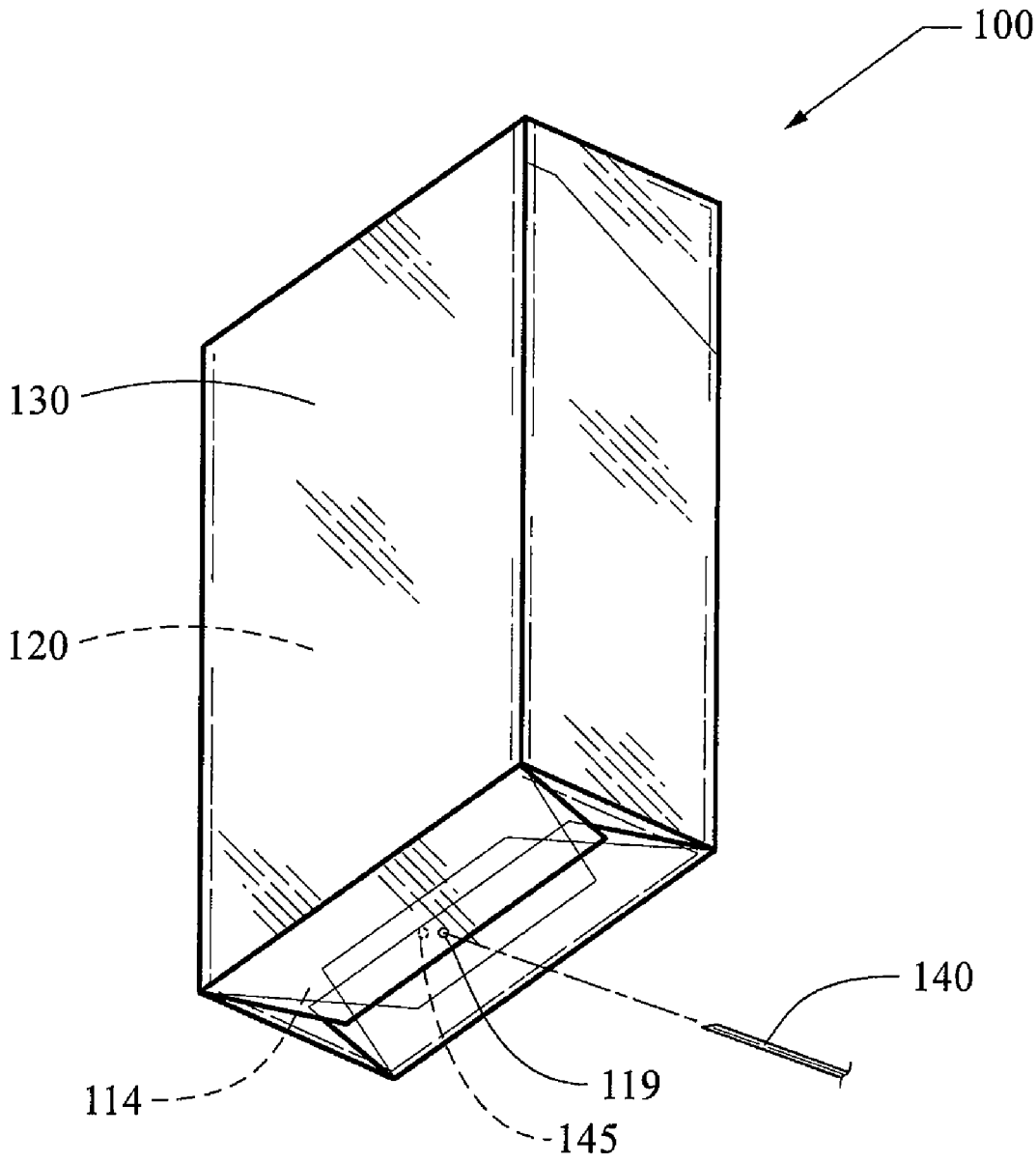
FIG. 2 shows a method of pressurizing a cigarette package.

A method of pressurizing the package 100 is described with reference to FIG. 2. A cannula 140 or other tool is provided to penetrate the sealed overwraps 120, 130 at a discrete entry location 119 that preferably is minimally visible or substantially not visible on a front, rear, top, or side face of the package 100 (e.g., a clear seal may be provided if the entry location 119 is in one of these faces, and/or it may be on the bottom of the package 100). The cannula 140 or other appropriate tool is used to introduce a pressurizing agent 145 (along a path shown by the broken-line arrow between the cannula 140 and the pressurizing agent 145). The pressurizing agent 145 is depicted diagrammatically as a small pellet, but preferably includes a discrete dosage of non-gaseous-phase of an inert gas such as carbon dioxide, nitrogen, or argon that may be in liquid or solid form. The cannula may be attached to a tank of pressurized liquid or a pellet-dispensing apparatus, and preferably is part of an automated dosing device configured to introduce a discrete dosage of the desired material in a repeated fashion during a manufacturing assembly process.

For example the pressurizing agent may be embodied as a pellet of dry ice (solid carbon dioxide), or a discrete quantity of liquid nitrogen or liquid argon. In one preferred embodiment, this portion of the method is carried out at a low temperature, such that only a minimal amount—if any—of the pressurizing agent 145 evaporates or sublimates into a gaseous phase before the entry location 119 is sealed. The pressurizing agent 145 most preferably is dosed according to the known principles relating gas volume with temperature and surrounding ambient pressure sufficient to provide a desired pressure in the sealed overwrapped package 100. The non-gaseous phase pressurizing agent 145 is allowed to evaporate or sublimate into a gaseous phase providing the desired pressure. The cannula or an accessory structure may be provided with a sealing adhesive or other sealing compound appropriate for sealing the overwraps to form a substantially airtight inner region configured to maintain a pressure.

The pressure in the package 100 preferably is greater than ambient air pressure outside the package. This provides an advantage of a firm-feeling package that communicates freshness to a consumer. Use of an inert gas of the types provided may provide freshness-maintaining properties for the smokable material (e.g., tobacco) in the cigarettes in the package. Generally a desirable pressure range inside the package 100—expressed in the amount by which it exceeds the surrounding ambient air pressure (which is typically about 14.7 psi) will be about three-tenths to about three pounds per square inch (about 0.3-3 psi, corresponding to about 20-200 mbar), and preferably about two to about three pounds per square inch (about 2-3 psi, corresponding to about 140-200 mbar) (to one significant figure). A preferred package may appear substantially similar to packages already present in the marketplace, while providing special advantages of communicated freshness and a pressurized inner space. The overwrap system described here may be used with known hard-packs or soft packs, including paperboard, polymer, foil, metal, and other known pack types. Other packaging may be configured to appear as a distinctive pouch around the inner cigarette pack.

FIG. 3A shows an assembled package 100, including a tear-tape 150. Representative types of tear tape materials suitable for use in association with other cigarette packaging materials may be available from sources such as Arlin Mfg. Co., Inc. of Lowell, Mass., and P.P. Payne Limited of Nottingham, United Kingdom.

The tear-tape 150 is provided for the convenience of a user in opening the overwraps 120, 130 around the package 100. The tear-tape 150 is shown as having outer and inner portions 150*a* and 150*b*. The inner portion includes a tear tape 150*b* disposed around the first, inner overwrap 120. The outer portion includes a tear tape 150*b* disposed around the second, outer overwrap 130. The outer tape 150*a* includes a "starter tab" 152*a* and the inner tape 150*b* includes a "starter tab" 152*b*. The adhesive 124 preferably is configured to maintain the fluid-tight seal of the package 100, and may therefore include a reinforcing portion as shown around each of the starter tabs 152*a*, 152*b*.

Figure 3B:
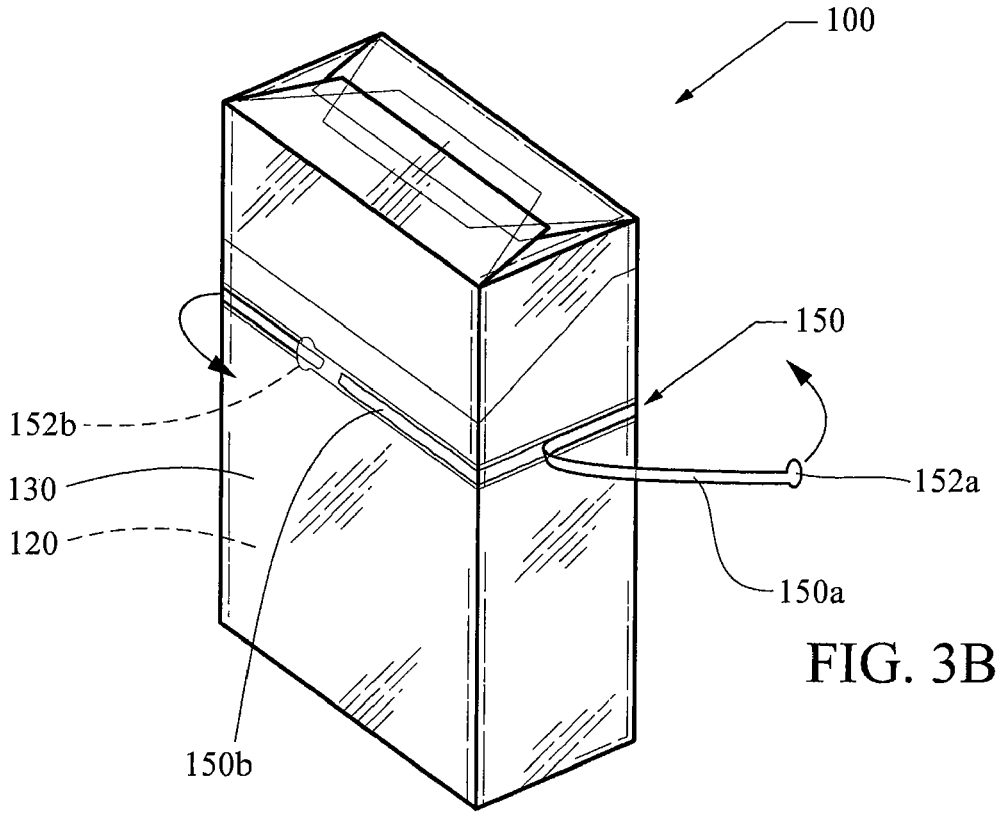
Figure 3C:
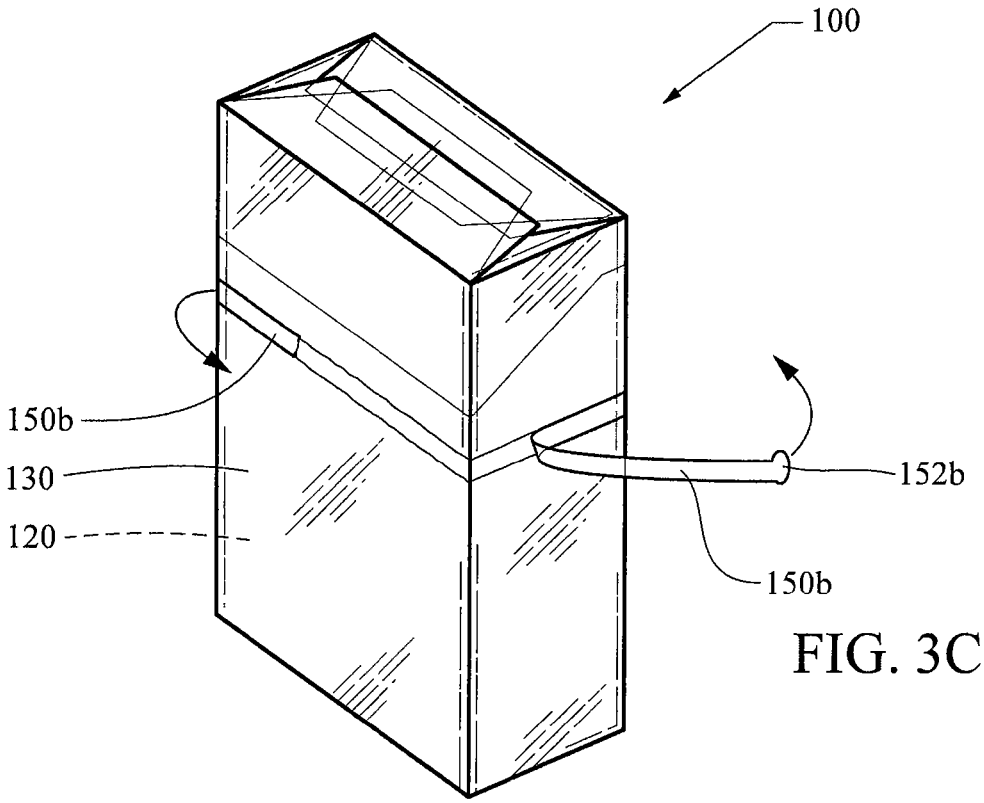

FIG. 3B shows a first step of opening the package 100 using the tear tape 150. As shown, a user grasps and pulls the outer starter tab 152*a*, drawing the outer tape 150*a*, tearing through outer wrap 130 along its length around the package 100 toward the inner starter tab 152*b*. The inner starter tab 152*b* may be attached to the outer tape 150*a*, and/or the user may also grasp the inner tab 152*b* to pull it along, tearing through the inner wrap 120. In the embodiment as shown in FIG. 3A, the outer tape 150*a* may be pulled all the way around the outer circumference of the package 100—substantially separating top and bottom portions of the outer wrap 130 and removed—before reaching the inner tab 152*b*, which may then be pulled around to open the inner wrap 120, as shown in FIG. 3C. However, the package 100 may be configured and/or used such that only a single "pull-around" action is required to separate top and bottom portions of the overwraps 120, 130 and provide access to the pack 102 so that it can be opened to access cigarettes therein.

Figure 3D:
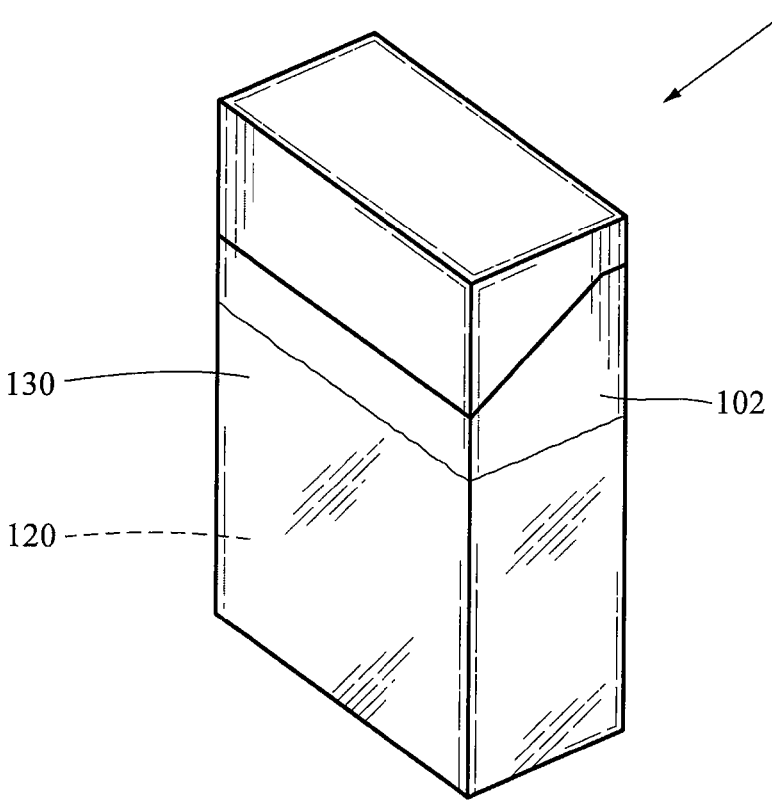

The outer tape 150*a* may be longitudinally attached to the inner starter tab 152*b*, such that a user need only pull on the outer starter tab 152*a* to unwind/tear-out the tape and open the overwrap. A border of adhesive (not shown) preferably seals around at least the outer starter tab 152*a* such that it can have a protruding edge or other graspable surface while maintaining a seal on the overwrap, and the same construction may be used around the inner starter tab 152*b*. Many different techniques in the art are known and used for starter tabs on tear tapes that those of skill in the art will readily apply here. FIG. 3D shows the package with both inner and outer tapes 150*a*, 150*b* and the top portion of the overwrap completely removed, allowing access to the lid of the pack and the cigarettes therein.

The maximum height of each package can vary. The height of each container assembly typically is dependent upon factors such as the lengths of the cigarettes that are contained therein. Generally, the height of the inner pack may be within the range of about 70 mm to about 130 mm. For example, in a package designed to contain cigarettes that are about 99 mm in length, a representative pack can have a height of about 100 mm to about 103 mm. Alternatively, for example, in a package designed to contain cigarettes that are about 84 mm in length, a representative pack may have a height of about 85 mm to about 89 mm.

The width of each pack can also be varied depending upon the number and arrangement of cigarettes to be held. Typically, the width of a representative pack configured to hold twenty cigarettes is at least about 55 mm, and often is at least about 60 mm. Typically, the width of a representative pack does not exceed about 70 mm and often does not exceed about 65 mm.

Likewise, the depth of each pack may be varied. For a pack configured to hold twenty cigarettes, the depth of a representative pack is at least about 20 mm and often is at least about 25 mm. Typically, the width of a representative pack does not exceed about 35 mm and often does not exceed about 30 mm. Preferably, the width and depth of the pack provide a convenient size for a user to carry (e.g., in a pocket or purse).

In a preferred embodiment, a representative assembled package has a height, width, depth, and overall shape that is comparable to that of cigarette packages that are traditionally employed to contain 20 cigarettes. As such, a preferred assembled container has overall dimensions that make it compatible with the dimensional requirements of applicable tax stamp machines and the associated carton re-casing requirements. A representative assembled hard-pack has a maximum height of about 85 mm, a width of about 63 mm, a maximum depth of about 33 mm, and a minimum depth of about 26 mm. An outer sleeve of a hard-pack may be constructed from paperboard having a thickness of about 0.012 inches (3.05 mm). A preferred paperboard, chipboard, or other hard-pack will include a laminate material such as, for example, metal foil, thermoplastic, or a combination formed as an inner or middle layer configured to help ensure pressure-tightness, particularly in the flat surfaces of the hard-pack.

The assembled container can be used in a variety of ways. In use, outer wrapper materials may be removed from the assembled outer container as described above, and partly or entirely discarded. The lid is moved to an open position to expose relevant interior wrapping materials (e.g., a piece of embossed paper/foil laminate that overlies the ends of the cigarettes, or that may enclose them) that cover the cigarettes contained in that packet.

The disclosed method, system, and materials provide an aesthetically pleasing appearance to a package of smoking articles, such as cigarettes. As described above, the modification of conventional packaging equipment in accordance with the teachings herein, such as precise placement of adhesive in coordinated patterns on transparent outer packaging materials, enables the creation of transparent packaging without visual impairment caused by the adhesive extending into visible areas. In comparison to conventional paperboard materials, the transparent packaging material requires greater precision to avoid visibly misapplied or squeezed-out adhesive patterns. Advantageously, the transparent packaging material allows decoratively embossed or patterned foil wrapper materials to visibly complement any patterns formed on the packaging material.

It should be appreciated that the overwrap structure and method described above may be applied to a cigarette carton. For example, an outer package containing 10 packs of cigarettes—whether traditional hard-packs or soft-packs, or packages that are overwrapped as described above—may itself be overwrapped and pressurized in the manner described above. This construction may also present a desirable aesthetic for consumers by providing a perception of "carton freshness."

Figure 4:
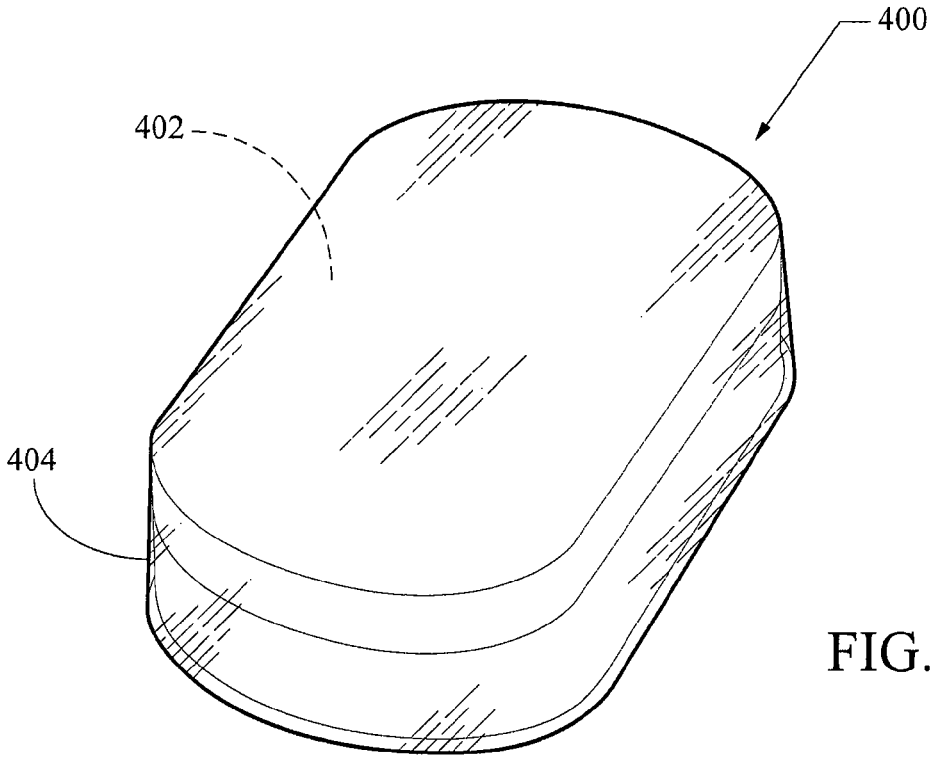
FIG. 4 shows a pressurized smokeless tobacco package.

This overwrapping and pressurization technology may also be applied to smokeless and other tobacco products. FIG. 4 shows a package 400 configured for containing a smokeless tobacco product. The package 400 includes an inner pack 402 containing a smokeless tobacco product (e.g., snuff, snus, or leaf-form chewing tobacco) or loose tobacco product such as that configured for use in "roll-your-own" cigarettes, pipes, or the like. The inner pack 402 is surrounded by a multi-layer overwrap 404 that may be configured and constructed in substantially the same manner, including for opening with a tear-tape or the like, as described above with reference to FIGS. 1A-3D. Alternatively, the overwrap may be constructed as a shrink-wrap-type film as known in the packaging art, and then pressurized in the manner described above. The inner pack 402 is shown as a lidded canister, but may be embodied as a pouch, box, or other container of the types traditionally used for tobacco products.

Figure 5A:
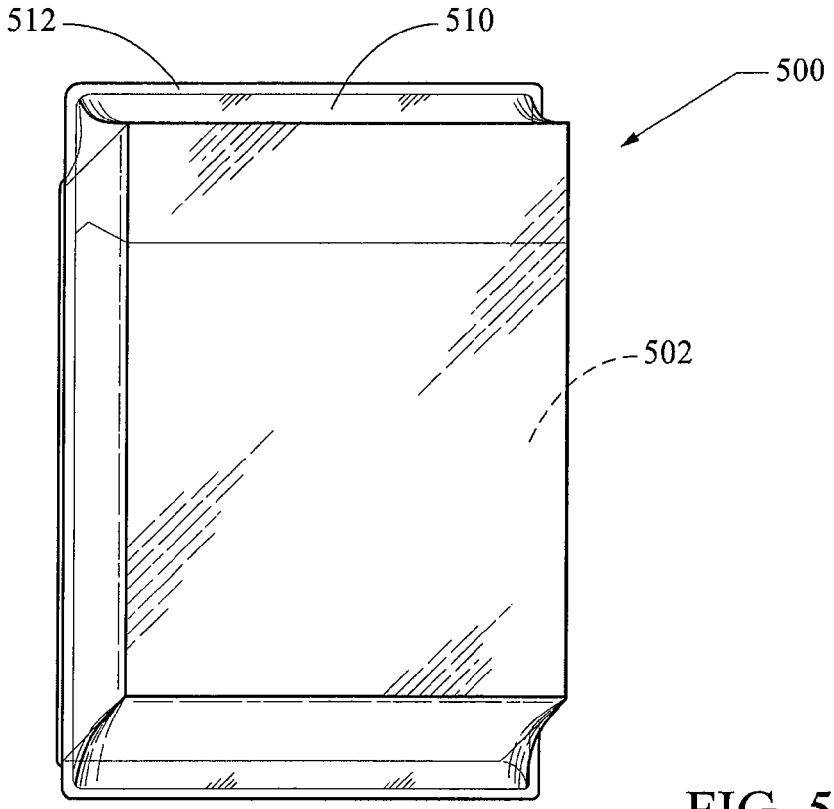
FIGS. 5A-5C show other embodiments of pressurized cigarette packages.
Figure 5B:
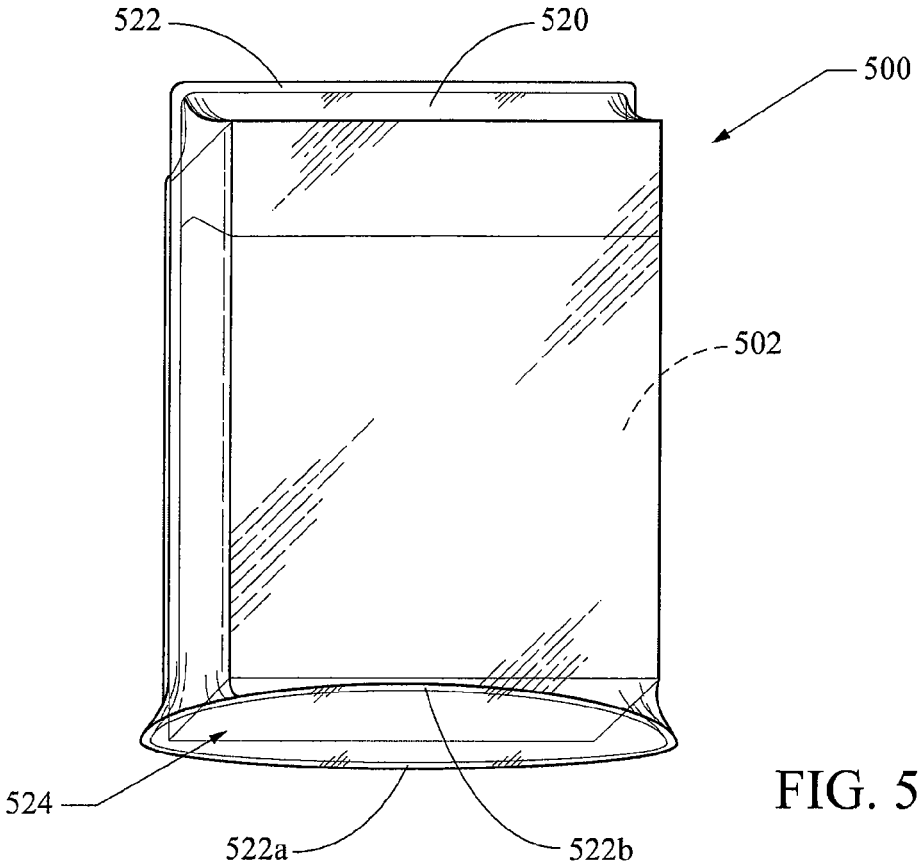
Figure 5C:
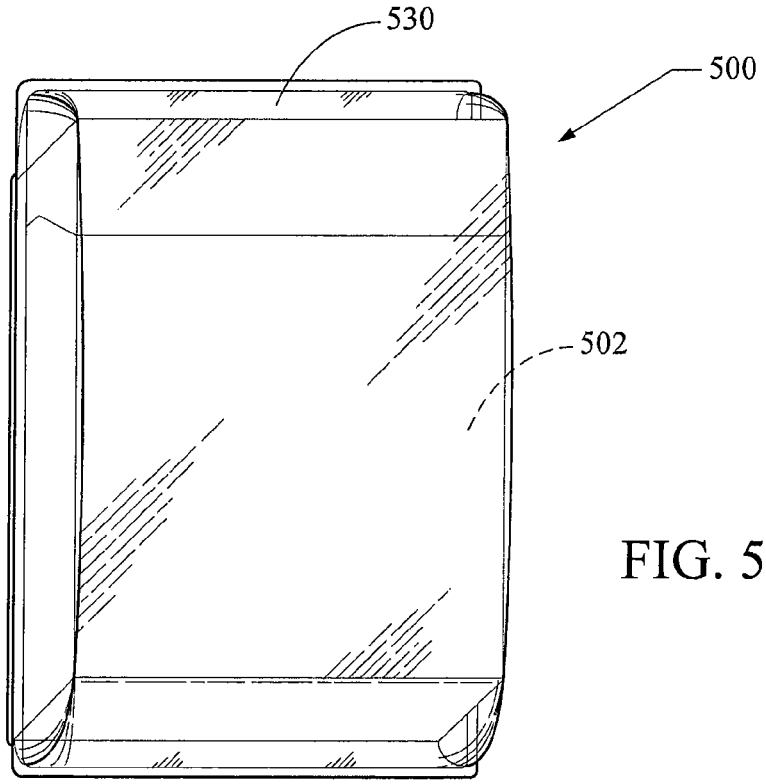

FIGS. 5A-5C illustrate other embodiments of a package 500 including an inner tobacco product pack 502 and a multilayer overwrap configured to maintain a higher pressure in an enclosed inner space around the pack 502 in the same manner as described above. However, each of these embodiments has a different overwrap geometry than the preferred embodiment described above, which preferably provides a package that looks virtually identical to a conventional package for the given product (e.g., a preferred cigarette package embodiment as shown in FIGS. 1C and 3A preferably will be nearly identical in appearance to a conventional cigarette package).

For the embodiment shown in FIG. 5A, the overwrap 510 includes a visible seam 512 around its generally rectangular border, which extends outward from the inner pack 502. The overwrap 510 is configured to generally conform to the outer contours of the inner pack 502, except for the laterally-extending seam portion that forms a border around the pack's top, bottom, and sides.

In the embodiment shown in FIG. 5B, the overwrap 520 also includes a seam 522, but it is constructed differently from the embodiment of FIG. 5A. Specifically, it is configured with a dual seam 522*a*, 522*b* on the bottom side, forming a bottom overwrap face 524 such that the package can stand up on its bottom (unlike the embodiment of FIG. 5A, which will rest most securely lying on its front or rear face).

Figure 6A:
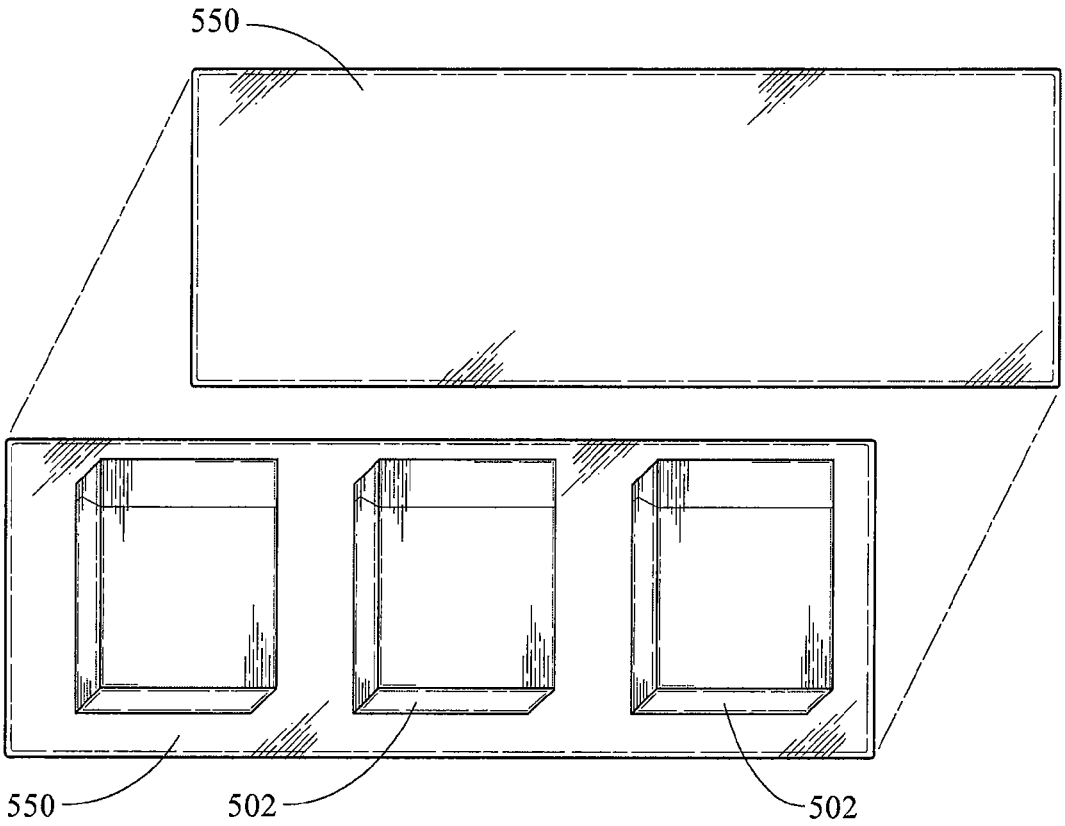
FIGS. 6A-6B show a method of assembling a pressurized cigarette package.
Figure 6B:
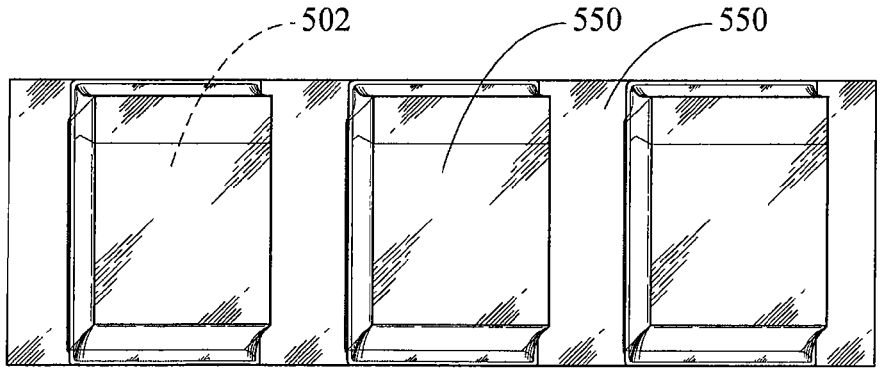

The package embodiment shown in FIG. 5C is similar to that of FIG. 5A, including an inner pack 502 and a multilayer overwrap 530. However, rather than generally conforming to the outer contours of the inner pack 502, the overwrap 530 is configured to "pillow outward" from the pressurized gas therein. In such an embodiment, it will be preferable that at least multiple surfaces of the inner pack 502 contact the overwrap 530 such that the inner pack 502 will not move freely (e.g., "rattle around") inside the overwrap 530. It will be appreciated by those of skill in the art that these embodiments may include a different assembly method than the method described above with reference to FIGS. 1A-1C. For example, in these embodiments, the packs 502 may be placed along a surface of a first sheet of overwrap film 550 as shown in FIG. 6A. Then a second sheet of overwrap film 550 may be placed over them and seams formed by heating, applying adhesive, heat-activating a thermo-sensitive adhesive, or applying other joining technique to form seams of the type shown in FIGS. 5A-5C. FIG. 6B shows a perspective of the packs 502, after the sheets of film 550 have been placed and sealed to form a seam around each, and a non-gas-phase charge of a pressurizing gas has been paced and sealed therein. In one embodiment of the method, this process may be repeated with a second layer of film (where the exterior-facing of the first layer 550 or the interior-facing surface of the second layer includes an adhesive as described above in other embodiments). Then, the packages may be separated (e.g., by cutting or other means) as individual packages such as, for example, the package 500 of FIG. 5A. This type of sealing process for placing film around a package is known, but has not previously included the further steps provided herein of including a sealed airtight barrier around a cigarette package and a higher pressure gas volume inside the sealed barrier.

Drawings in the figures illustrating various embodiments are not necessarily to scale. Some drawings may have certain details magnified for emphasis, and any different numbers or proportions of parts should not be read as limiting, unless so-designated by one or more claims. Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention.

We claim:

1. A pressurized cigarette package comprising:

an inner pack portion containing a plurality of cigarettes;

an outer wrapper forming a substantially airtight barrier around the inner pack portion;

a tear tape attached to the outer wrapper and configured to be torn through at least a portion of the outer wrapper, where the tear tape comprises a first tear tape portion attached to the outer layer of the outer wrapper and a second tear tape portion attached to the inner layer of the outer wrapper; and a pressurized gas contained within the outer wrapper, where the pressurized gas is at a pressure greater than an ambient air pressure;

wherein the outer wrapper comprises at least an inner layer and an outer layer, configured where an adhesive material coating a surface area of one of an outer-facing surface of the inner layer and an inner-facing surface of the outer layer substantially adheres it to a surface area of the other of the outer-facing surface of the inner layer and the inner-facing surface of the outer layer sufficient to form a substantially airtight seal therebetween.

2. The cigarette package of claim 1, where the pressurized gas is selected from carbon dioxide, argon, and nitrogen.

3. The cigarette package of claim 1, where the adhesive is selected from a group consisting of polypropylene, EVA, EBA, ethylenevinylacetate maleic anhydride terpolymer, anhydride grafted polyolefin, ethyleneacrylicester maleic anhydride terpolymer, ethyleneacrylicester glycidyl methacrylate terpolymer, ionomer, HEVA, EAA, LEVA, LLDPE, LDPE, EMA, EMMA, PVA, acrylic, PVdC, vinyl, polyester, polyamide, moisture-curable polyurethane, SBS, silicone, and any combination thereof.

4. The cigarette package of claim 1, where the adhesive covers substantially an entire surface of the inner layer of the outer wrapper.

5. The cigarette package of claim 1, where at least one of the inner layer and the outer layer of the outer wrapper comprises a material selected from the group consisting of nitrile copolymer film, polypropylene film, metalized copolymer film, laminated copolymer film, thin solid aluminum, alumina ($Al_2O_3$)-coated polyethylene terephthalate (PET) film, transparent alumina-coated PET film, silicon oxide-coated PET film, EVOH-coated film, and any combination thereof.

6. The cigarette package of claim 1 comprising a pressure that is about 0.3 to about 3 psi greater than an ambient air pressure.

7. The cigarette package of claim 1 comprising a pressure that is about 2 to about 3 psi greater than an ambient air pressure.

8. The cigarette package of claim 1 where the inner pack portion comprises a paperboard hard pack including a laminate material.

9. The cigarette package of claim 1 where the inner pack portion comprises a cuboid parallelepiped-shaped box.

10. The cigarette package of claim 9 where the outer wrapper closely conforms to the inner pack portion.

11. A pressurized cigarette package comprising:

an inner pack portion containing a plurality of cigarettes;

an outer wrapper forming a substantially airtight barrier around the inner pack portion;

where the outer wrapper comprises at least one tear tape configured for tearing through and removing a portion of the outer wrapper, and where the at least one tear tape comprises a first tear tape portion configured to tear through the outer layer of the outer wrapper and a second tear tape portion configured to tear through the inner layer of the outer wrapper; and a pressurized gas contained within the outer wrapper, where the pressurized gas is at a pressure greater than an ambient air pressure;

wherein the outer wrapper comprises at least an inner layer and an outer layer, configured where an adhesive material coating a surface area of one of an outer-facing surface of the inner layer and an inner-facing surface of the outer layer substantially adheres it to a surface area of the other of the outer-facing surface of the inner layer and the inner-facing surface of the outer layer sufficient to form a substantially airtight seal therebetween.

12. A pressurized tobacco product package comprising:

an inner pack portion containing a tobacco product;

an outer wrapper forming a substantially airtight barrier around the inner pack portion; and a pressurized gas contained within the outer wrapper, where the pressurized gas is at a pressure greater than an ambient air pressure;

wherein the outer wrapper comprises at least an inner layer and an outer layer, configured where an adhesive material coating a surface area of one of an outer-facing surface of the inner layer and an inner-facing surface of the outer layer substantially adheres it to a surface area of the other of the outer-facing surface of the inner layer and the inner-facing surface of the outer layer sufficient to form a substantially airtight seal therebetween;

where the outer wrapper comprises at least one tear tape configured for tearing through and removing a portion of the outer wrapper, said at least one tear tape comprising a first tear tape portion configured to tear through the outer layer of the outer wrapper and a second tear tape portion configured to tear through the inner layer of the outer wrapper.

13. The package of claim 12 where the tobacco product is selected from a plurality of cigarettes, a loose smoking tobacco product, and a smokeless tobacco product.

14. A pressurized cigarette package comprising:

an inner pack portion containing a plurality of cigarettes;

a transparent outer wrapper forming a substantially airtight barrier around the inner pack portion; and a pressurized gas contained within the outer wrapper, where the pressurized gas is at a pressure greater than an ambient air pressure;

wherein the outer wrapper comprises at least a transparent inner layer and a transparent outer layer, configured where a transparent adhesive material coating a surface area of one of an outer-facing surface of the inner layer and an inner-facing surface of the outer layer substantially adheres it to a surface area of the other of the outer-facing surface of the inner layer and the inner-facing surface of the outer layer sufficient to form a substantially airtight seal therebetween and to provide visibility of the inner pack portion.

* * * * *